US006719195B2

(12) United States Patent
Farentinos

(10) Patent No.: US 6,719,195 B2
(45) Date of Patent: Apr. 13, 2004

(54) SECURITY DROPBOX WITH PIVOTING SERVICE BIN

(75) Inventor: Chris Farentinos, Redondo Beach, CA (US)

(73) Assignee: Architectural Mailboxes, Inc., Torrance, CA (US)

( * ) Notice: Subject to any disclaimer, the term of this patent is extended or adjusted under 35 U.S.C. 154(b) by 0 days.

(21) Appl. No.: 10/215,731

(22) Filed: Aug. 9, 2002

(65) Prior Publication Data

US 2004/0026492 A1 Feb. 12, 2004

(51) Int. Cl.[7] ..... B65G 11/04
(52) U.S. Cl. ..... 232/45; 232/47; 232/49
(58) Field of Search ..... 232/45, 47, 43.1, 232/43.2, 17, 49, 50, 51

(56) References Cited

U.S. PATENT DOCUMENTS

| | | | | | |
|---|---|---|---|---|---|
| 555,948 | A | * | 3/1896 | Harrison et al. | 232/49 |
| 567,283 | A | * | 9/1896 | Spencer | 232/51 |
| 1,141,806 | A | * | 6/1915 | Loudenslager | 232/45 |
| 2,874,896 | A | * | 2/1959 | Hickman | 232/35 |
| 3,519,198 | A | * | 7/1970 | Benoliel | 232/17 |
| 3,874,583 | A | * | 4/1975 | Moll | 232/17 |
| 3,880,344 | A | | 4/1975 | Earle | |
| 3,976,345 | A | | 8/1976 | Walters | |
| 3,981,436 | A | * | 9/1976 | Neal | 232/17 |
| D254,635 | S | | 4/1980 | Earle | |
| 4,363,438 | A | * | 12/1982 | Connor | 232/30 |
| 4,724,999 | A | | 2/1988 | Fitzgerald et al. | |
| 4,756,471 | A | * | 7/1988 | Zumach | 232/17 |
| 4,863,096 | A | * | 9/1989 | Thomas | 232/17 |
| 4,905,891 | A | | 3/1990 | Wildish et al. | |
| 4,993,626 | A | | 2/1991 | Berry | |
| 5,000,378 | A | | 3/1991 | Dorr et al. | |
| D328,513 | S | | 8/1992 | McKinney | |
| 5,137,212 | A | * | 8/1992 | Fiterman et al. | 232/43.2 |
| 5,207,377 | A | * | 5/1993 | Brecht | 232/17 |
| D354,610 | S | | 1/1995 | Hassan | |
| 5,400,960 | A | | 3/1995 | Jeffs | |
| 5,526,979 | A | | 6/1996 | Mann | |
| D388,232 | S | | 12/1997 | Valentino | |
| 6,299,061 | B1 | * | 10/2001 | Henson | 232/47 |
| 6,378,767 | B1 | * | 4/2002 | Steele | 232/19 |

* cited by examiner

*Primary Examiner*—William L. Miller
(74) *Attorney, Agent, or Firm*—O'Melveny & Myers LLP

(57) ABSTRACT

A security dropbox for receiving mail and like items includes an enclosure having walls. The enclosure walls include a front wall with an opening for receiving delivered items. A service door covers the opening on an exterior of the enclosure. The service door is pivotably attached to the front wall adjacent to a lower rim of the opening, and has an interior side facing the enclosure. A service bin is disposed on the interior side of the service door. The service bin is positioned to hold delivered items when the service door is open and to drop the delivered items when the service door is closed. A secure bin is disposed in the enclosure under the service bin. The secure bin is positioned to receive the delivered items dropped from the service bin. The service bin is made up of the interior side of the service door, a bin floor extending at an obtuse angle from the interior side of the service door, and bin sidewalls extending between adjacent edges of the service door and the bin floor. The bin configuration allows the dropbox to securely receive larger packages, in a relatively compact space. The security dropbox also includes features for protecting delivered items from moisture damage, and an outgoing mail clip.

17 Claims, 4 Drawing Sheets

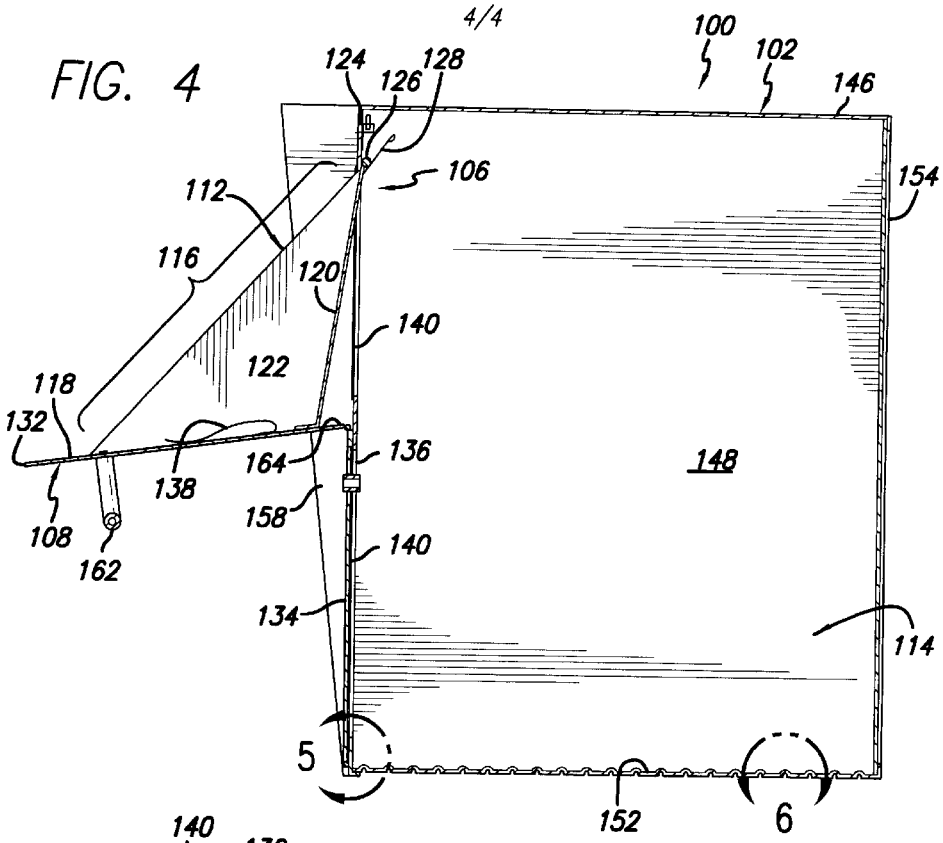
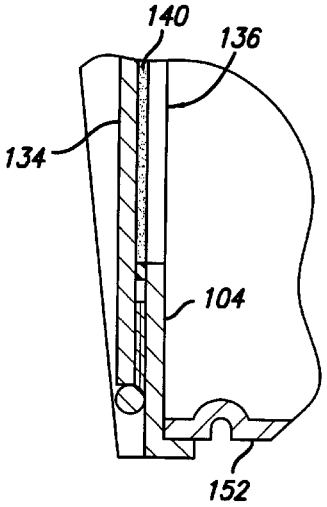
FIG. 5
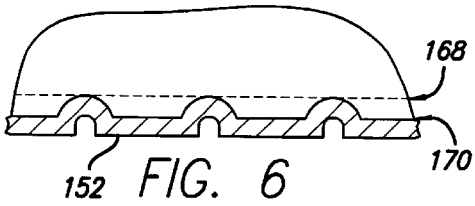
FIG. 6

SECURITY DROPBOX WITH PIVOTING SERVICE BIN

BACKGROUND OF THE INVENTION

1. Field of the Invention

The present invention relates to receptacles for receiving mail or other delivered articles, and for securely holding such articles until the receptacle is opened by an authorized user, thereby preventing theft or other loss.

2. Description of Related Art

Security dropboxes are known in the art for receiving mail or other delivered articles in a relatively secure way. Such dropboxes are designed for installation in publicly accessible areas, such as near public streets. Delivered items may be placed in such dropboxes by a postal carrier or other delivery person via an unlocked service door or slot. The delivered objects then drop into a receiving chamber that can be accessed through a locked access door. In addition to providing locking access doors, such boxes secure delivered objects by employing blocking structures between the service opening and the receiving chamber. The blocking structures prevent intruders from reaching into the receiving chamber to withdraw objects residing therein through the service opening. Various types of blocking structures are known in the art, having their own various advantages and disadvantages.

While the general principles of security dropboxes of the type described above are well understood, prior art dropboxes of this type suffer from certain limitations. For example, blocking structures used in prior art dropboxes are less than optimal. To the extent that prior art security dropboxes secure the items already in the receiving chamber, they do so by making the dropbox unnecessarily large, heavy and/or complex, relative to the size of the items to be delivered. It would be desirable, therefore, to provide an improved security dropbox that provides for secure delivery of mail and small packages without sacrificing compactness, reliability, and low cost.

Another drawback of prior art blocking structures is that the serviceability of the dropboxes for package delivery is too readily sacrificed for security of the service opening, or vice-versa. That is, it is difficult to deposit packages above a certain, undesirably small size in prior art dropboxes having more secure service openings. Conversely, if the prior art dropbox more readily accepts larger packages, it will tend to compromise the security of received items by making it easier to reach through the service opening into the receiving chamber. The trade-offs that prior art dropboxes provide between serviceability and security are unacceptable in the modern world, where package delivery of critical items, such as prescription medication, is increasingly commonplace and the theft of mail is all too common. It would further be desirable, therefore, to provide an improved security dropbox that is capable of receiving larger packages without sacrificing security.

Further deficiencies of prior-art security dropboxes include inadequate protection from moisture intrusion. In rural areas, it is often desirable to mount security dropboxes as delivery mailboxes in relatively unprotected areas, to facilitate the delivery of mail. During inclement weather, water may be driven into the dropbox, through edges of a closed service door or access door. Moisture may also enter the dropbox when a service door or access door is opened by a user. Accordingly, an improved security dropbox should also provide greater protection against moisture damage to received items.

SUMMARY OF THE INVENTION

The present invention provides a security dropbox with a pivoting service bin, that provides for secure delivery of items such as mail and packages in a relatively compact space. The security dropbox may be relatively lightweight and economical to construct, and is suitable for many different applications; for example, as a security mailbox for curbside installation in rural areas. The invention further provides features for protecting delivered items from moisture damage.

A security lockbox according to the invention essentially comprises a walled enclosure. The enclosure may be provided in any suitable shape, for example, in an embodiment of the invention, the enclosure is substantially a rectangular prism (box-like shape). The enclosure has an opening through an upper portion of one of its walls, to receive delivered items. The opening is covered by a service door that is pivotably attached to the enclosure adjacent to a lower rim of the opening.

A service bin is disposed on an interior side of the service door. The service bin is positioned to hold delivered items when the service door is open, and to drop delivered items when the service door is closed. A secure bin is in the enclosure under the service bin, positioned to receive delivered items dropped from the service bin.

The configuration of the service bin serves several purposes. One purpose is to provide, in combination with the service door opening, a blocking structure that prevents items from being removed from the secure bin of the dropbox through the service opening. A second purpose is to drop the items deposited into the service bin into the secure bin when the service door is closed. Still another purpose is to provide a secure dropbox with a minimum of moving parts. The service bin is operated by the opening and closing of the service door, and therefore, no moving mechanisms apart from the hinge (or other pivoting attachment) of the service door are required.

In an embodiment of the invention, these purposes are achieved by providing a service bin comprised of an interior side of the service door, a substantially flat bin floor extending at an obtuse angle from the interior side of the service door, and bin sidewalls extending between the adjacent edges of the service door and the bin floor. In other words, the service bin may be a v-shaped bin with one floor of the bin provided by the service door itself. A service bin such as this may function effectively as a blocking structure to prevent reaching into the enclosure, while being compact and economical to construct. With this type of bin, it may be desirable for the obtuse angle to be just large enough so that items in the service bin will fall to the secure bin when the service door is closed. This may provide a more compact dropbox than would otherwise be possible.

In an embodiment of the invention, greater moisture protection is provided for delivered items by provided a gasket of weather-resistant sealing material between the service door and the perimeter of the service opening. A similar gasket may be provided around other openings into the enclosure. The gasket prevents moisture from being driven into the enclosure during inclement weather. Another feature for improved protection from moisture is a specially configured receiving floor in the secure bin. The receiving floor has an upper portion for supporting delivered items, and a lower portion for receiving drainage from the upper portion. The invention is operable without these enhancements, which should therefore be regarded as optional improvements.

Other features may optionally be added to the secure dropbox. For example, a pivoting flag to indicate the presence of outgoing mail may be added. A related optional feature is a spring clip or pocket inside the service door, for holding outgoing mail. For further example, the secure bin may be provided with a lockable access door. The access door may be positioned at any suitable location on the enclosure. Yet another example of an enhancement is a magnetic latch for the service door. One of ordinary skill will appreciate other features and enhancements for the secure dropbox, depending on its intended application.

A more complete understanding of the security dropbox with pivoting service bin will be afforded to those skilled in the art, as well as a realization of additional advantages and objects thereof, by a consideration of the following detailed description of the preferred embodiment. Reference will be made to the appended sheets of drawings, which will first be described briefly.

BRIEF DESCRIPTION OF THE DRAWINGS

FIG. 4 is a cross-sectional view of the exemplary dropbox shown in FIG. 1, with the service door open.

FIG. 5 is a detail view of a wall section of the exemplary dropbox shown in FIG. 1, showing an exemplary sealing gasket.

FIG. 6 is a detail view of a floor section of the exemplary dropbox shown in FIG. 1.

DETAILED DESCRIPTION OF THE PREFERRED EMBODIMENT

The present invention provides a security lockbox with a pivoting service bin, that overcomes the limitations of prior art dropboxes. In the detailed description that follows, like element numerals are used to indicate like elements appearing in one or more of the figures.

Figure 1:
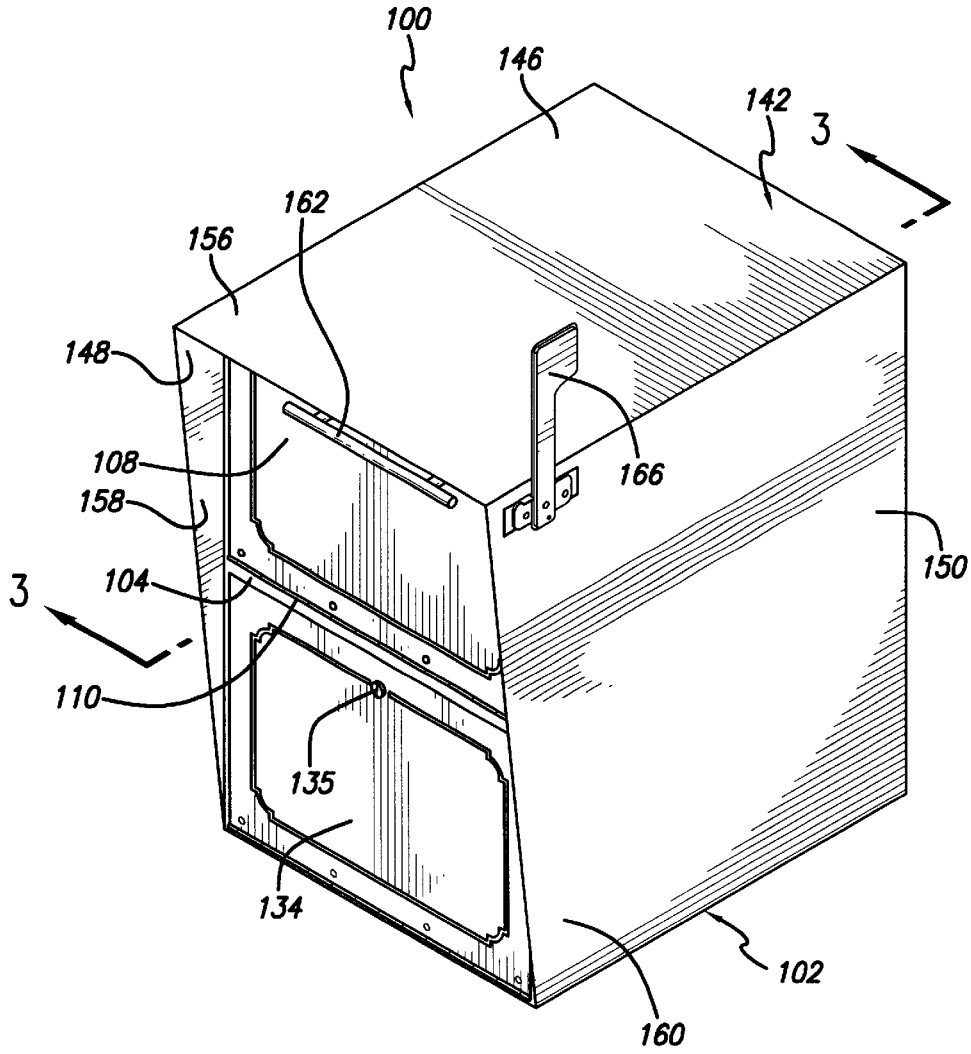
FIG. 1 is a perspective view of an exemplary security dropbox according to the invention, with the service door closed.
Figure 2:
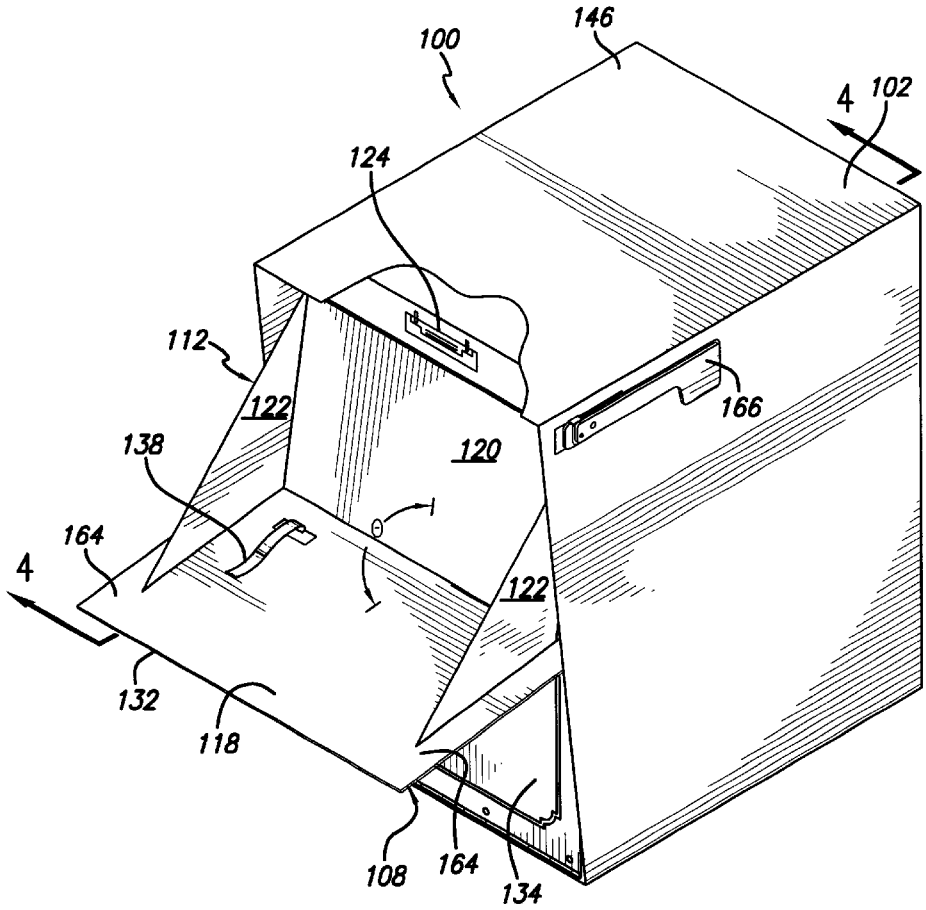
FIG. 2 is a perspective view of the exemplary dropbox shown in FIG. 1, with the service door open.
Figure 3:
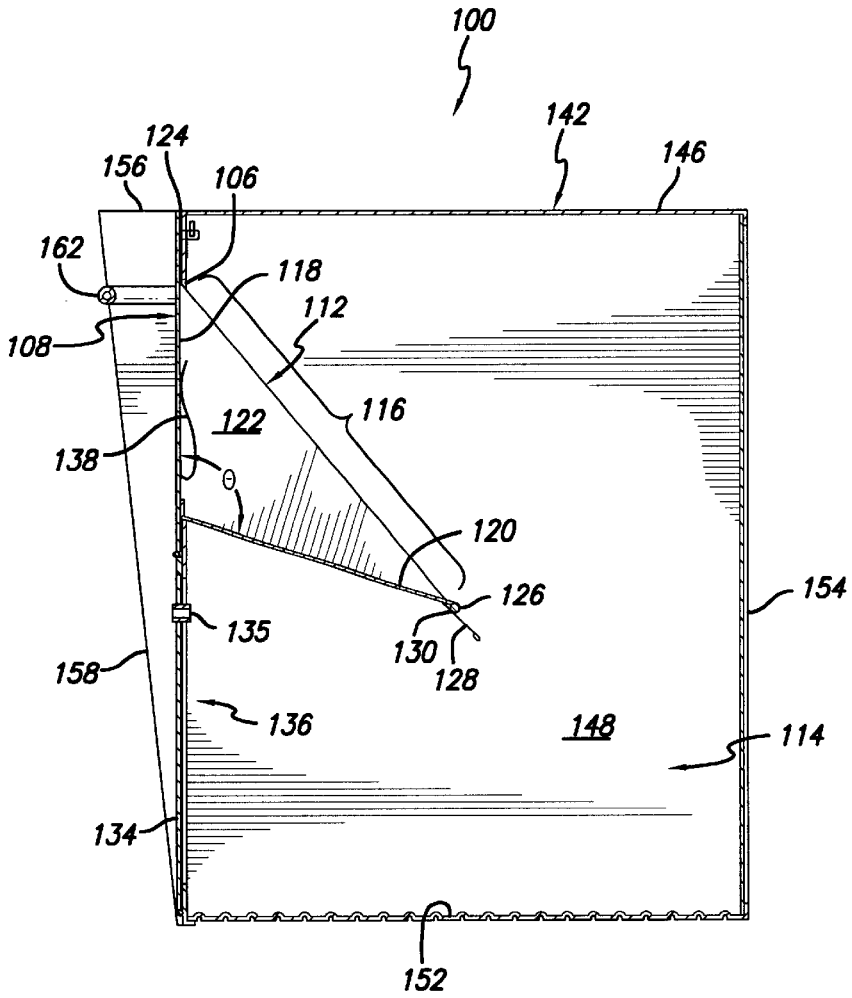
FIG. 3 is a cross-sectional view of the exemplary dropbox shown in FIG. 1, with the service door closed.

Referring to FIGS. 1–4, an exemplary embodiment of a security dropbox according to the invention is shown in various views. Perspective views are shown in FIGS. 1 and 2, and side cross-sectional views in FIGS. 3 and 4. The security dropbox is shown with the service door in a closed position in FIGS. 1 and 3, and with the service door in a fully open position in FIGS. 2 and 4, respectively. The exemplary embodiment is described below with reference to FIGS. 1–4 generally.

Security dropbox 100 comprises an enclosure 102 generally in the shape of a rectangular prism. Enclosure 102 may be formed from a sheet metal material, such as steel. It may be powder-coated, painted, or provided with any other protective coating for corrosion protection, and to enhance the appearance of the enclosure. In alternative embodiments, any other suitable metal, plastic, or other structural material may be substituted for sheet steel. In addition, enclosure 102 may be formed in different shapes, for example, cylindrical or spherical, with appropriate adjustments to the service bin and other components of dropbox 100, as should be apparent to one of skill in the art.

Enclosure 102 comprises a front wall 104, a top wall 146, opposite side walls 148, 150, a bottom wall 152, and a rear wall 154. Front wall 104 may be essentially configured as a frame with two large openings 106, 136. Service opening 106 is covered by service door 108, and serves for delivery of items such as mail. Access opening 136 is covered by access door 134, and provides access to the interior of enclosure 102. It may be advantageous to form top wall 146 and side walls 148, 150 together from a single piece of sheet material 142, which may therefore serve as a drip/moisture shield for enclosure 102. In addition, it may also be advantageous to shape the top wall 146 and side walls 148, 150 so as to provide an overhang 156 over the service opening 106. Overhang 156 may enhance the security of dropbox 100 by making it more difficult to reach around service bin 112, and may also provide some enhanced moisture protection for enclosure 102. The overhang with its tapered side supports may also make the dropbox more aesthetically pleasing.

Opening 106 should be disposed in a upper portion of the enclosure 102. It may be disposed in a flat, vertically-oriented front wall in the upper portion of the dropbox, as shown. In alternative embodiments, the opening may be disposed in some other face in the upper portion of the dropbox, such as in an inclined or curved face. Opening 106 is covered by a service door 108 that is pivotably attached, such as by a hinge 110, to the front wall adjacent to a lower rim of opening 106. Door 108 therefore opens by pivoting out and down. When in a closed position, it may be held by a suitable latch, such as magnetic latch 124 over the upper rim of opening 106. A pull handle 162 may be attached to service door 108 adjacent to upper edge 132.

To better cover opening 106, the dimensions of service door 108 should be larger than those of the opening, thereby providing an outer margin 164 around the periphery of the service door. A sealing gasket 140 may then be disposed between front wall 104 and the outer margin 164, thereby preventing moisture from entering enclosure 102. Any suitable gasket material may be used for gasket 140, for example, a closed cell urethane foam strip with an adhesive backing.

A service bin 112 is disposed on an interior side 118 of service door 108. Service bin 112 may have any suitable shape that will hold delivered items when the service door is open (such as when in the position shown in FIGS. 2 and 4), and drop the delivered items into the enclosure 102 when the service door is closed (such as when in the position shown in FIGS. 2 and 4). Service bin 112 should further be configured to block would-be intruders from reaching around the service bin into the lower part of enclosure 102, when the service door is in a open position. Accordingly, in an embodiment of the invention, the service bin comprises an obliquely extending portion 116 transverse to the service door. When the service door is closed, the obliquely extending portion 116 leads into the interior of enclosure 102, such that an item held in portion 116 will fall into the enclosure.

To prevent someone from reaching around it, portion 116 is sufficiently long, and when the service door 108 is in an open position, its distal edge 130 is positioned sufficiently far above bottom 152, so that it is not possible to reach around the service bin from outside of the opening 106 to reach items resting in the secure bin 114 of dropbox 100. One of the advantages of the invention is that, as the service door is opened, the distal edge 130 of the service bin moves progressively further away from the secure bin. Thus, service bin 112 provides an effective blocking structure while being of a relatively compact size.

It should be appreciated that the shape of the service bin 112, and in particular, the obliquely extending portion 116, will depend on factors such as the shape of enclosure 102, the shape and location of opening 106, the shape and orientation of the service door 108, and the depth of enclosure 102. Various different shapes may be suitable. In an embodiment of the invention, the obliquely extending portion 116 of service bin 112 comprises a bin floor 120 extending at an obtuse angle θ from the interior side 118 of service door 112 to a distal end 130, and a pair of bin sidewalls 122 extending between adjacent surfaces of the service door and bin floor, at opposing sides of the service bin. Obtuse angle θ may be any obtuse angle, but for a more compact dropbox using a vertically-oriented service door, an value of θ between about 110 degrees and 135 degrees is believed particularly suitable. For example, in an embodiment of the invention, a θ value of 116 degrees was used. In the same embodiment, to prevent reaching around, the distal end 130 of the bin floor 120 was between about nineteen and twenty inches from the upper edge 132 of the service door. Of course, other values may also be appropriate, depending on the configuration of the service bin.

Bin sidewalls 122 serve as strengthening gussets for bin floor 120, for increasing the overall strength and rigidity of the service bin. The bin sidewalls also prevent someone from reaching around the sides of the bin floor into the enclosure 102. Bin sidewalls 122 may extend from the bin floor adjacent its distal end 130, to the service door adjacent its upper edge 132. Optionally, an extension piece 128 may be attached along the edge of the bin floor at its distal end 130, for increased security.

In addition, a protruding doorstop 126 may be provided anywhere along the edges of the bin floor, for example, adjacent to distal end 130. The doorstop should be positioned to strike the front wall or adjacent member when the service door is in a fully open position. For greater strength, it may be desirable to provide a doorstop protruding from each opposing side of the bin floor. The doorstop 126 should be sufficiently strong to prevent an intruder from forcing the service bin out of opening 106.

For applications wherein dropbox 100 is to be used as a mailbox, service bin 112 may be provided with a clip 138 for holding outgoing mail in the service bin until it can be retrieved by a postal carrier. The clip may be a piece of spring steel configured to hold outgoing mail against the interior side 118 of the service door. In the alternative, an outgoing mail pocket, or any other suitable mail holding device, may be provided on the interior side of the service door. It may further be desirable, for mailbox applications, to provide an outgoing mail flag 166 at a suitable location on the outside of enclosure 102.

The enclosure 102 should be provided with a second opening 136 for access to secure bin 114. Opening 136 is covered by access door 134, which may be locked and unlocked using keylock 135. Like the service door, the access door 134 may overlap the outer perimeter of the access opening 136 for greater security and moisture protection. Sealing gasket 140 may be disposed between a perimeter of the access door and the front wall 104, as shown in FIG. 5, similarly to sealing of service door 108. Access door 134 may be hinged at its bottom edge to the front wall, like the service door. In the alternative, the access door may be hinged along a side edge, or may be configured in some other fashion. The access opening may be provided in the front wall 104, or at any other suitable location on enclosure 102.

Secure bin 114 is positioned under the service bin 112 to receive items dropped from the service bin when the service door is closed. In an embodiment of the invention, the contours of the secure bin are defined by lower portions of the side walls 148 and 150, rear wall 154, front wall 104, and bottom 152. This provides an economical, compact configuration. In alternative embodiments, the secure bin may be a separate structure inside of enclosure 102, and/or coupled to enclosure 102 in some other way. For example, a secure bin may be configured as a detachable container below the service bin, obviating the need for an access door. Instead, delivered items could be accessed by unlocking and detaching a detachable secure bin.

In an embodiment of the invention, bottom 152 serves as a receiving floor for the secure bin 114, as shown in FIGS. 4 and 6. For security of the delivered items, floor 152 should be set sufficiently below the distal end 130 of secure bin 112, so that items in the secure bin can not be reached through the service opening 106, allowing for the anticipated accumulation of delivered items in the secure bin. In the embodiment shown in FIGS. 3 and 4, the distance between the bottom of the secure bin 114 and the floor 152 is about eight inches. Generally speaking, greater distances to floor 152 provide a deeper secure bin, and will allow secure receipt of a larger volume of mail and larger packages. It is believed that the configuration depicted is a reasonable design for residential mail delivery. Of course, more or less depth in the secure bin may be desired, depending on the intended application.

As shown in FIG. 6, to protect delivered items from accumulated moisture, receiving floor 152 may be provided with an upper portion 168 for contacting delivered items in secure bin 114, and a lower portion 170 for receiving drainage from the upper portion and any wet delivered items thereon. The upper portion 168 and lower portion 170 may be provided by forming a plurality of dimples 172 or other protrusions in the receiving floor 152. Drainage holes (not shown) may also be provided through the receiving floor 152. In the alternative, or in addition, a bi-layer floor may be provided. For example, floor 152 may be comprised of two spaced-apart sheets, with an upper sheet for supporting delivered items, and a lower sheet receiving drainage from the upper sheet.

Having thus described a preferred embodiment of the security dropbox with pivoting service bin, it should be apparent to those skilled in the art that certain advantages of the within system have been achieved. It should also be appreciated that various modifications, adaptations, and alternative embodiments thereof may be made within the scope and spirit of the present invention. For example, a particular configuration of service bin has been illustrated, but it should be apparent that the inventive concepts described above would be equally applicable to other dropboxes with various different shapes and configurations of service bins. The scope of the invention is to be determined solely by the following claims.

What is claimed is:

1. A security dropbox, comprising:

an enclosure having walls, the enclosure walls comprising a front wall having an opening;

a service door covering the opening on an exterior of the enclosure, the service door pivotably attached to the front wall adjacent to a lower rim of the opening, and having an interior side facing the enclosure and an exterior side opposite to the interior side;

a service bin disposed on the interior side of the service door, the service bin positioned to hold delivered items when the service door is open and to drop the delivered items into the enclosure when the service door is closed, wherein the service bin comprises the interior side of the service door and an obliquely extending portion transverse to the service door, the obliquely extending portion leading into the enclosure when the service door is closed and configured to block reaching into an interior of the enclosure when the service door is open, wherein the obliquely extending portion comprises a bin floor extending at an obtuse angle from the interior side of the service door, and bin sidewalls extending between adjacent surfaces of the service door and the bin floor, and wherein the service bin further comprises a protruding door stop adjacent to a distal end of the bin floor; and a secure bin in the enclosure under the service bin, the secure bin positioned to receive the delivered items dropped from the service bin.

2. The dropbox of claim 1, wherein the bin floor extends from the service door to the distal end, and the bin sidewalls extend between the distal end of the bin floor and the service door adjacent to an upper edge of the service door.

3. The dropbox of claim 2, wherein the distal end of the bin floor is at least about eighteen inches away from the upper edge of the service door.

4. The dropbox of claim 1, wherein the obtuse angle is at least 110 degrees and not greater than 135 degrees.

5. The dropbox of claim 1, further comprising a lockable access door in the enclosure walls, the access door covering a second opening in the enclosure, the second opening providing access to the secure bin.

6. The dropbox of claim 5, wherein the second opening is in the front wall below the service door.

7. The dropbox of claim 1, further comprising an outgoing mail clip disposed on the interior side of the service door.

8. The dropbox of claim 1, further comprising a sealing gasket interposed between a perimeter of the service door and the front wall.

9. The dropbox of claim 1, wherein the enclosure walls further comprise a single folded sheet of material making up a top wall and opposite side walls of the enclosure.

10. The dropbox of claim 1, wherein the enclosure walls comprise a sheet metal material.

11. The dropbox of claim 1, wherein the enclosure walls further comprise an overhanging portion over the service door.

12. The dropbox of claim 1, wherein the secure bin further comprises a receiving floor, the receiving floor having an upper portion for contacting the delivered items in the secure bin, and a lower portion for receiving drainage from the upper portion.

13. The dropbox of claim 12, wherein the upper portion of the receiving floor comprises upper surfaces of a plurality of protrusions in the receiving floor.

14. The dropbox of claim 1, further comprising a pull handle disposed on the exterior side of the service door.

15. The dropbox of claim 1, wherein the service door is in a substantially vertical orientation when closed.

16. The dropbox of claim 1, further comprising an outgoing mail flag pivotably attached to the enclosure.

17. The dropbox of claim 1, wherein the enclosure is substantially in the shape of a rectangular prism.

* * * * *